US006584638B2

(12) United States Patent
Nigh et al.

(10) Patent No.: US 6,584,638 B2
(45) Date of Patent: Jul. 1, 2003

(54) MESH BRUSH

(75) Inventors: Nancy K. Nigh, St. Louis, MO (US); Kevin M. Corcoran, Des Peres, MO (US); Glory S. C. Yang, Taipei (TW)

(73) Assignee: SBI, Incorporated, Saint Louis, MO (US)

( * ) Notice: Subject to any disclaimer, the term of this patent is extended or adjusted under 35 U.S.C. 154(b) by 16 days.

(21) Appl. No.: 09/973,521

(22) Filed: Oct. 8, 2001

(65) Prior Publication Data

US 2003/0066152 A1 Apr. 10, 2003

(51) Int. Cl.[7] ..... A47K 7/02
(52) U.S. Cl. ..... 15/209.1; 15/229.13
(58) Field of Search ..... 15/209.1, 210.1, 15/229.11, 229.13; 300/21

(56) References Cited

U.S. PATENT DOCUMENTS 3,924,288 A * 12/1975 Breland
5,687,447 A 11/1997 Bynum et al.
5,983,435 A 11/1999 Osborne
6,092,258 A 7/2000 Chen
6,276,022 B1 * 8/2001 Gallacher
6,453,503 B1 * 9/2002 Chen

OTHER PUBLICATIONS

Product Catalog, Bath & Beauty Products, Schroeder and Tremayne, Inc., 2001(see p. 4).

* cited by examiner

*Primary Examiner*—Randall E. Chin
(74) *Attorney, Agent, or Firm*—Thompson, Coburn, LLP

(57) ABSTRACT

A mesh brush has a handle and a mesh sponge is fixed to one side of the head of the handle. The head of the handle flares out from and is wider than a grasping portion of the handle. The particular attachment between the mesh sponge and the head of the handle is accomplished by wrapping a cord around the mesh sponge and threading the cord through multiple eyelets distributed around the head. A rim around the perimeter of the head produces a recess on one side thereof. The portion of the cord looped around the mesh sponge fits within the perimeter of the head and can be at least partially recessed within the head.

12 Claims, 1 Drawing Sheet

MESH BRUSH

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

This invention relates generally to brushes having a mesh sponge fixed to the head of a handle, and more particularly, to a mesh sponge attached to one side of the handle's head by a cord wrapped around the mesh sponge and threaded through eyelets in the handle's head.

2. Description of Related Art

There are many types of cleansing devices that are useful for body washing and personal hygiene. Some of these devices include mesh sponges attached to different types handles. Prior cleansing devices sought to improve on their manufacture, their durability, and their feel to a user. Such cleansing devices use several different approaches for attaching mesh sponges to handles. Even with such prior improvements, there continues to be more demand for improving the manufacture, durability and feel of cleansing devices, including improvements in the attachment of mesh sponges to handles.

BRIEF SUMMARY OF THE INVENTION

It is in view of the above demand for improved manufacture, durability and feel of cleansing devices that the present invention was developed. The invention provides a mesh brush with a handle and a mesh sponge fixed to one side of the head of the handle. The handle has a grasping portion and the head of the handle flares out from the grasping portion. The particular attachment between the mesh sponge and the head of the handle is accomplished by wrapping a cord around the mesh sponge and threading the cord through a plurality of eyelets in the head. In the preferred embodiment, the head of the handle has a rim around its perimeter, thereby producing a recess on one side thereof. The portion of the cord looped around the mesh sponge fits within the perimeter of the head and can be at least partially recessed within the head.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE INVENTION

Figure 1:
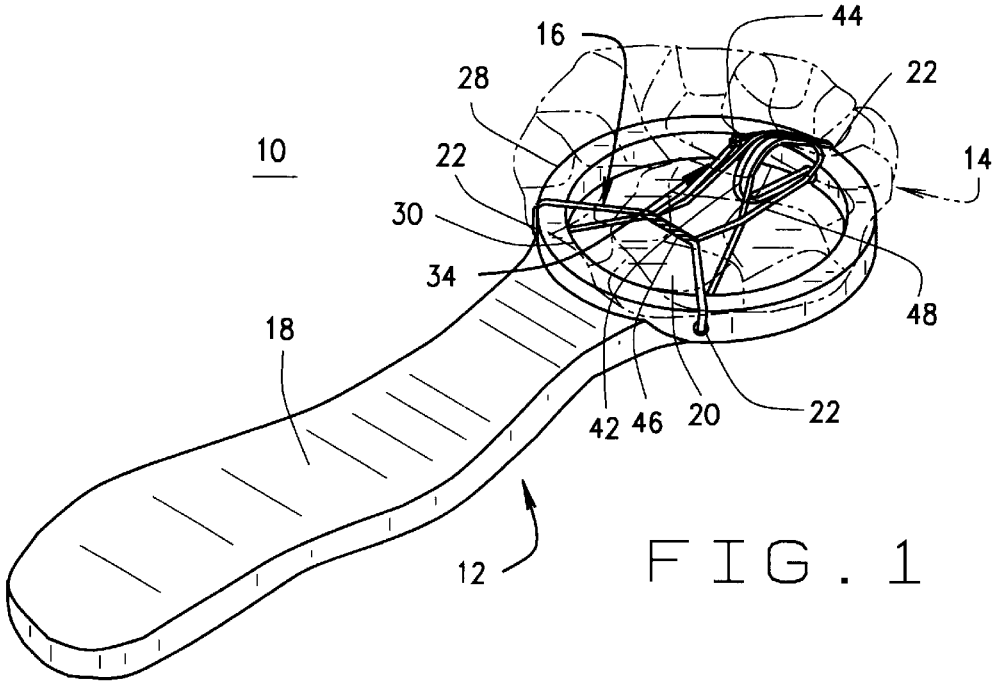
FIG. 1 is a perspective view of a preferred embodiment of the present invention.
Figure 2:
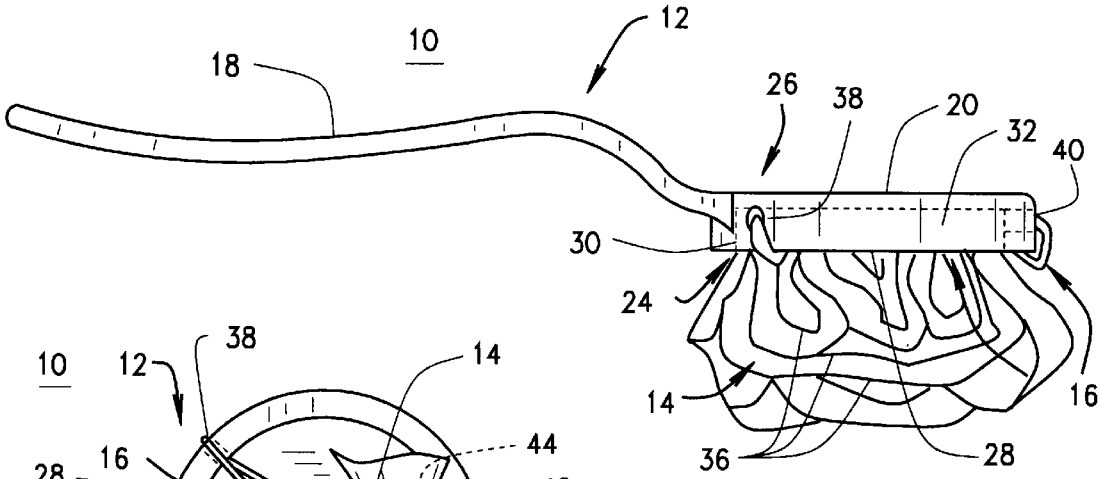
FIG. 2 is a side elevation view of the embodiment according to FIG. 1.

Referring to the accompanying drawings in which like reference numbers indicate like elements, FIGS. 1 and 2 illustrate a preferred embodiment of a mesh brush 10 with a handle 12 and a mesh sponge 14 fixed thereto with a cord 16. The handle 12 has a grasping portion 18 and a wider head 20 that flares out from the grasping portion 18. The cord 16 is wrapped around the mesh sponge 14 and threaded through a plurality of eyelets 22 in the head 18.

The mesh sponge 14 is preferably fixed to a front surface 24 of the head 20, and the back surface 26 of the head 20 is shown to be substantially flat and circular, although it will be appreciated that the back surface can also be other shapes and is not limited to being flat. The eyelets 22 are preferably equidistantly distributed around the perimeter 28 of the head 20, and the perimeter 28 may have a rim 30, thereby forming a recess 32 in the front surface 24 of the head 20.

One way to improve the durability of the mesh brush 10 is to protect the cord 16 from being damaged. The cord 16 loops around the mesh sponge 14, and preferably loops around the center of the mesh sponge 14 to form a bundled center portion 34. When the eyelets 22 are distributed around the perimeter 28 of the head 20, the bundled center portion 34 is secured to the handle 12 within the perimeter 28, protecting the bundled center portion 34 from being damaged. Additionally, a plurality of folds 36 flare away from the bundled center portion 34 and protect the cord 16 that is threaded through the eyelets 22 in the head 18. Further, when the rim 30 is formed in the perimeter 28, the bundled center portion 34 is at least partially recessed in the recess 32 in the front surface 24 of the head 20.

Another way to improve the durability of the mesh brush 10 is to more securely mount the mesh sponge 14 to the handle 12. Although the present invention for the mesh brush 10 would work with only a pair of the eyelets 38 distributed on substantially opposite sides of the head 20 (e.g., the two eyelets closest to the grasping portion 18) without any additional eyelet, such a design would permit the mesh sponge 14 to rotate about the axis between such pair of eyelets. By including at least one additional eyelet 40 that is not linearly aligned with the pair of eyelets 38, the cord 16 can secure the mesh sponge 14 in a manner that the bundled center portion 34 is substantially restricted from rotating. Without the additional eyelet 40, the cord 16 could have a looped segment 42 around the bundled center portion 34 of the mesh sponge 14 and could be threaded through the pair of eyelets 38. The ends of the cord 16 would be tied into a knot 44, thereby fixing said mesh sponge to said handle. By including the additional eyelet 40, the cord 16 can more securely attach the mesh sponge 14 to the head 20 of the handle 12 with a wrapped segment 46 and a tensioning segment 48. In the preferred embodiment, the wrapped segment 46 is located between the pair of eyelets 38 and the tensioning segment 48 loops around the bundled center portion 34 and pulls said wrapped segment 46 towards said bundled center portion 34.

The head 20 being wider than the grasping portion 18 also improves the efficacy and feel of the mesh brush 10. The grasping portion 18 of the mesh brush 10 can fit comfortably within the hand of a user, while the wider head 20 evenly distributes pressure to the folds 36 of the mesh sponge 14. If the grasping portion 18 was as wide as the head 20 and elongated as it is, it would not fit as comfortably with the user's hand. Similarly, if the head 20 was as narrow as the grasping portion 18, it would not distribute pressure as evenly to the folds 36 of the mesh sponge 14.

Figure 3:
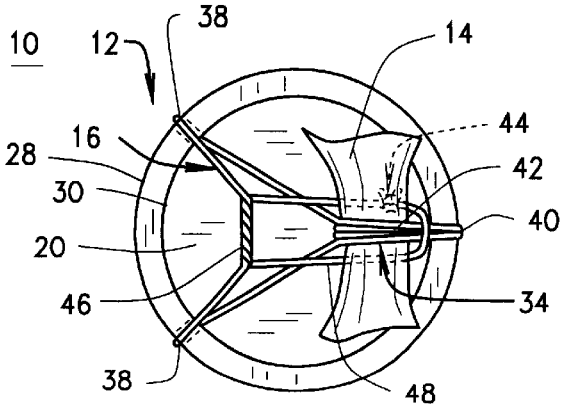
FIG. 3 is a plan view of another embodiment of the present invention.

Referring to FIG. 3, it will be appreciated that the handle 12 does not require a grasping portion 18 that is distally elongated from the head 20. The embodiment illustrated in FIG. 3 is similar to the preferred embodiment in all respects except that it does not have a grasping portion 18. Without any grasping portion 18, the head 20 itself serves as the entirety of the handle 12, such that the hand of a user can grasp the head 20 to manipulate the mesh brush 10.

The preferred method of using the cord 16 to attach the mesh sponge 14 to the handle 12 is also particularly described with reference to FIG. 3. The pair of eyelets 38 are formed in the handle 12, and the additional eyelet 40 (at least one but could be more) is formed in the handle 12 such that the additional eyelet 40 is not linearly aligned with the pair of eyelets 38. The cord 16 is looped around the mesh sponge 14 and is threaded through the pair of eyelets 38 and through the additional eyelet 40 before tying a knot 44 into the cord 16. The looped segment 42 of the cord 16 forms the bundled center portion 34 of the mesh sponge 14. As described above, the cord 16 can be wrapped between the pair of eyelets 38 and pulled around the bundled center portion 34 before tying the knot 44, thereby respectively forming the wrapped segment 46 and the tensioning segment 48. It will be appreciated the grasping portion 18 is also formed in the handle 12 for the preferred embodiment.

In view of the foregoing, it will be seen that the several advantages of the invention are achieved and attained. The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, the rim 30 and other features can be integrally formed or may be formed by machining or other manufacturing techniques based on the materials used to produce the mesh brush 10. Thus, the breadth and scope of the present invention should not be limited by any of the above-described exemplary embodiments, but should be defined only in accordance with the following claims appended hereto and their equivalents.

What is claimed is:

1. A mesh brush, comprising:

a handle having a grasping portion and a head flaring from said grasping portion, said head having a front surface, a back surface and a perimeter, the perimeter of the head having a rim and at least a pair of eyelets and at least one additional eyelet not linearly aligned with said pair of eyelets, said rim forming a recess in said front surface of said head, said head being wider than said grasping portion and said pair of eyelets being distributed around said perimeter on substantially opposite sides of said head;

a mesh sponge fixed to said handle at said front surface of said head, said mesh sponge having a bundled center portion and a plurality of folds flaring away from said bundled center portion;

a cord having a wrapped segment located between said pair of eyelets and a tensioning segment looped around said bundled center portion and pulling said wrapped segment towards said bundled center portion of said sponge, said cord tied in a knot, thereby fixing said mesh sponge to said handle; and wherein said cord loops around said bundled center portion of said mesh sponge such that said bundled center portion is within said perimeter and at least partially recessed in said front surface of said head.

2. A mesh brush according to claim 1, wherein said back surface of said head is substantially flat and circular.

3. A mesh brush, comprising:

a handle having a head, said head having a front surface, a back surface, a pair of eyelets, and at least one additional eyelet, said pair of eyelets being set apart from said additional eyelet such that said additional eyelet is not linearly aligned with said pair of eyelets;

a mesh sponge fixed to said handle at said front surface of said head; and a cord threaded through each of said pair of eyelets and through said additional eyelet and looped around said mesh sponge, said cord tied in a knot, thereby fixing said mesh sponge to said handle;

wherein said mesh sponge has a bundled center portion and a plurality of folds flaring away from said bundled center portion, said bundled center portion being formed by said cord looping around said mesh sponge; and wherein said cord further comprises a wrapped segment and a tensioning segment, said wrapped segment being located between said pair of eyelets and said tensioning segment being looped around said bundled center portion and pulling said wrapped segment towards said bundled center portion.

4. A mesh brush according to claim 3, wherein said handle further comprises a grasping portion.

5. A mesh brush according to claim 4, wherein said head flares from said grasping portion and said back surface of said head is substantially flat and circular.

6. A mesh brush according to claim 5, wherein said head further comprises a rim, thereby forming a recess in said front surface of said head.

7. A mesh brush according to claim 6, wherein said pair of eyelets and said additional eyelet are formed in and distributed around said rim.

8. A mesh brush comprising:

a mesh sponge having a bundled center portion and a plurality of folds extending from said bundled center portion;

a handle having a grasping portion and a head generally at one end of said grasping portion, said head having a front surface and a back surface, said front surface having a front face and a protrusion extending forward of said front face;

an eyelet extending through said protrusion in a manner such that said eyelet is forward of said front face;

a cord extending through said eyelet and operatively connecting said mesh sponge to said handle.

9. A mesh brush according to claim 8 wherein said protrusion comprises a peripheral rim of said head.

10. A mesh brush according to claim 8 wherein the entirety of said eyelet is forward of said front face.

11. A mesh brush according to claim 8 wherein the entirety of said eyelet is forward of the entirety of said front face.

12. A mesh brush comprising:

a mesh sponge having a bundled center portion and a plurality of folds extending from said bundled center portion;

a handle comprising a head having a front surface and a back surface, said front surface having a front face and a protrusion extending forward of said front face;

an eyelet extending through said protrusion in a manner such that said eyelet is forward of said front face;

a cord extending through said eyelet and operatively connecting said mesh sponge to said handle.

* * * * *